US006357245B1

(12) United States Patent
Weng et al.

(10) Patent No.: US 6,357,245 B1
(45) Date of Patent: Mar. 19, 2002

(54) APPARATUS FOR MAKING HOT-WATER BY AIR CONDITIONER/HEATER

(75) Inventors: Kuo-Lian Weng; Jing-Wen Weng, both of Taichung Hsien (TW)

(73) Assignee: Cohand Technology Co., Ltd., Taichung Hsien (TW)

( * ) Notice: Subject to any disclaimer, the term of this patent is extended or adjusted under 35 U.S.C. 154(b) by 0 days.

(21) Appl. No.: 09/845,192

(22) Filed: May 1, 2001

(51) Int. Cl.[7] ..... F25B 27/00
(52) U.S. Cl. ..... 62/238.6; 62/238.7; 62/180
(58) Field of Search ..... 62/238.6, 238.7, 62/180, 184, 196.4, 79, 324.1, 324.6; 237/19

(56) References Cited

U.S. PATENT DOCUMENTS 4,598,557 A * 7/1986 Robinson et al. ..... 62/238.6
4,809,516 A * 3/1989 Jones ..... 62/238.7 X
6,123,147 A * 9/2000 Pittman ..... 62/238.6 X

* cited by examiner

*Primary Examiner*—Denise L. Esquivel
*Assistant Examiner*—Chen-Wen Jiang
(74) *Attorney, Agent, or Firm*—Rosenberg, Klein & Lee

(57) ABSTRACT

An apparatus for making hot-water by an air conditioner/heater is provided. The apparatus comprises a heat recovery device so that the apparatus can make hot-water by utilizing exhaust heat in air conditioning or heating cycle. Further, the apparatus can make hot-water independently. The apparatus can increase thermal efficiency.

2 Claims, 20 Drawing Sheets

APPARATUS FOR MAKING HOT-WATER BY AIR CONDITIONER/HEATER

FIELD OF THE INVENTION

The present invention relates to air conditioners and more particularly to an apparatus for making hot-water by air conditioner/heater.

BACKGROUND OF THE INVENTION

A conventional air conditioner 1 is shown in FIG. 1. The air conditioner 1 comprises a compressor 11, a heat recovery device 18, a heat exchanger (e.g., condenser) 12, a fan motor 13, a filter 14, and a coolant flow controller 15 (all above components are installed outdoors). The air conditioner 1 further comprises a heat exchanger (e.g., evaporator) 16 and a fan motor 17 (both are installed indoors). With this configuration, it is possible to air condition an enclosed space (A0). However, the previous design suffered from several disadvantages. For example, the rotating speed of each fan motor is fixed, i.e., it is not adapted to ambient temperature (or outlet temperature) change. As understood that, heat exchange capability of air conditioner is proportional to wind speed which in turn is proportional to motor speed. Thus, heat exchange capability is proportional to motor speed. Hence, the heat exchange capability of the air conditioner is low in nature due to such fixed rotating speed of fan motor, resulting in a waste of energy. Further, the capability of heat dissipation of condenser is always larger than the capability of heat absorption of evaporator. Hence, it is difficult for such conventional air conditioner to operate as heater when desired. Furthermore, the thermal efficiency is unacceptable low even when the air conditioner operates as heater. Moreover, the heat recovery efficiency is very low due to the fixed rotating speed of fan motor as stated above. In addition, there is no arrangement for making hot-water by the air conditioner. Thus, improvement exists.

SUMMARY OF THE INVENTION

It is an object of the present invention to provide an apparatus for making hot-water by an air conditioner/heater, said apparatus comprising an outdoor section including a compressor, a heat recovery means, a heat exchanger, a fan motor, a filter, and a coolant flow controller; an indoor section including a heat exchanger and a fan motor; and a control section for air conditioning, heating, or supplying hot-water to an enclosed space, said control section including a central processing unit (CPU), a directional-control valve, a defrost bypass valve, a plurality of sensors, and a control panel wherein said CPU is operable to compare a plurality of sensed values obtained from said sensors with a plurality of predetermined values, control on-off of said compressor, switch of said directional-control valve, speed selections of said fan motors, and on-off of said defrost bypass valve, said directional-control valve is switched to permit a predetermined coolant to flow through by a selection of an air conditioning or heating mode, said sensors are located on said heat exchanger of said outdoor section, said heat exchanger of said indoor section, said enclosed space, and said heat recovery means respectively for sensing temperatures including outlet temperatures of said heat exchangers of said outdoor and indoor sections, an ambient temperature of said enclosed space, and an temperature of said heat recovery means, said heat recovery means comprises a coil with said coolant flowing through for exchanging heat, further comprising a cold water supply line, a hot-water line both in fluid communication with said heat recovery means, a water pump on said hot-water line, a hot-water reservoir on said hot-water line, the hot-water reservoir having a baffle plate and a sensor, a check valve for controlling output from said hot-water reservoir, and an overflow pipe extended from said bottom of said hot-water reservoir to a predetermined position above said coil in said heat recovery means for transferring hot-water back to said heat recovery means when said check valve is turned off.

The above and other objects, features and advantages of the present invention will become apparent from the following detailed description taken with the accompanying drawings.

DETAILED DESCRIPTION OF THE PREFERRED EMBODIMENTS

Figure 1:
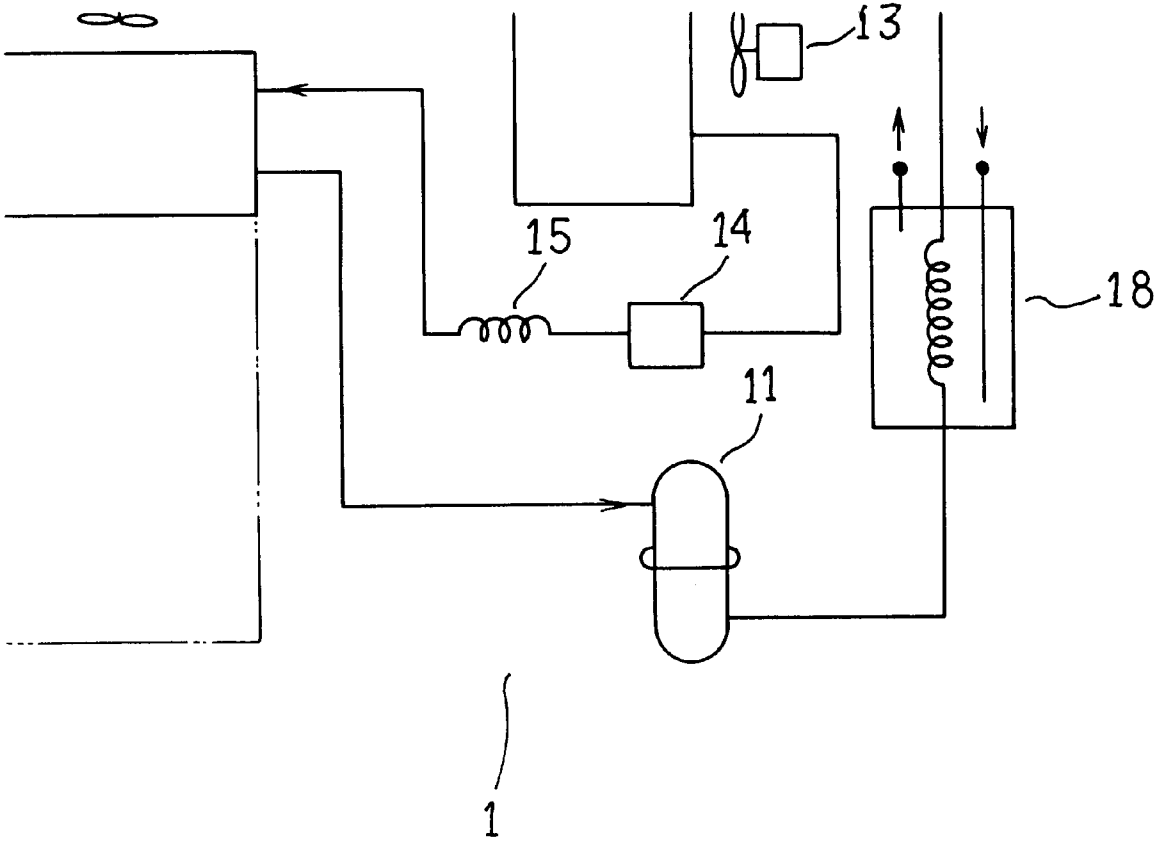
FIG. 1 PRIOR ART
FIG. 1 is a schematic drawing of a conventional air conditioner.
Figure 2:
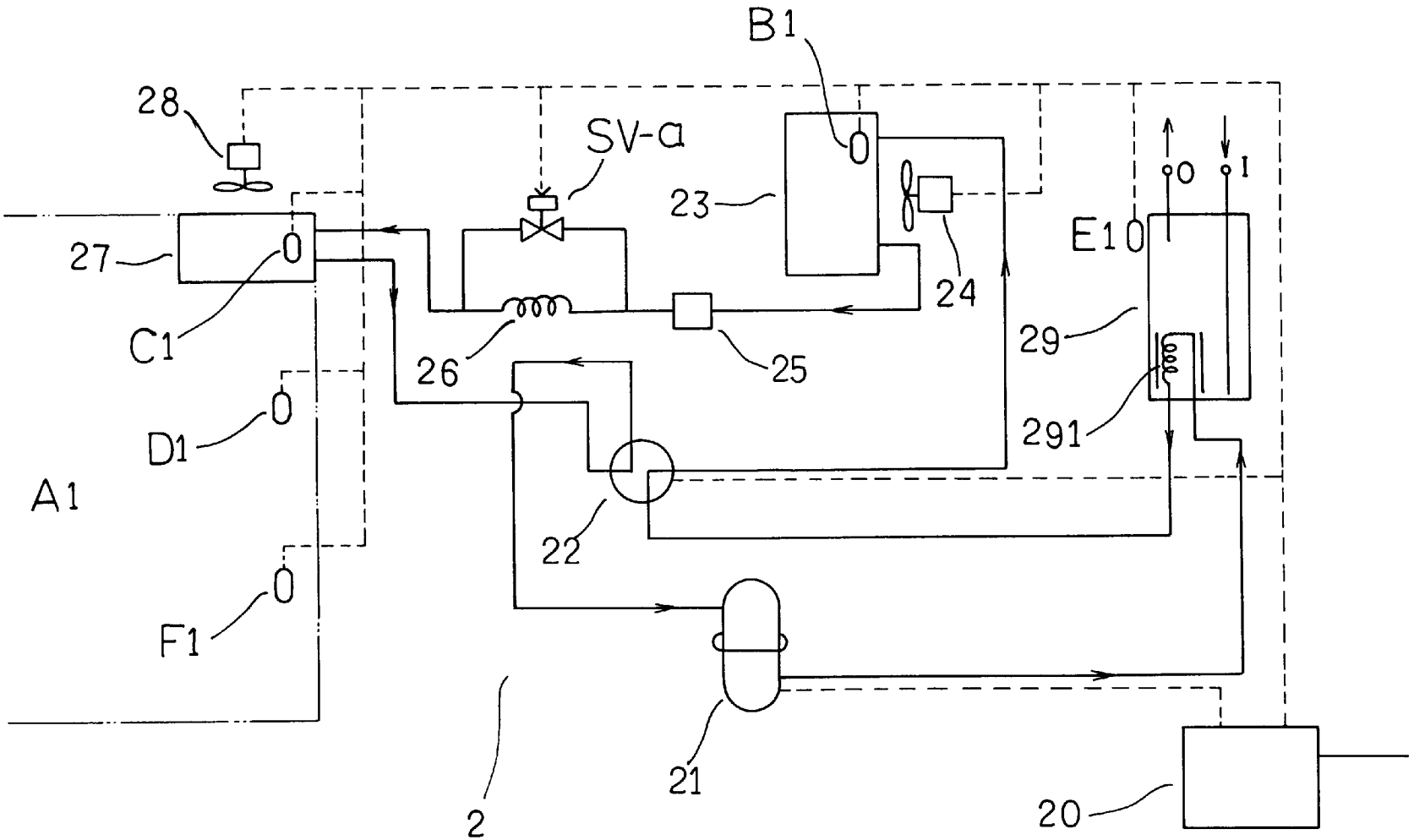
FIG. 2 is a schematic drawing of a first preferred embodiment of air conditioner/heater according to the invention.
Figure 3:
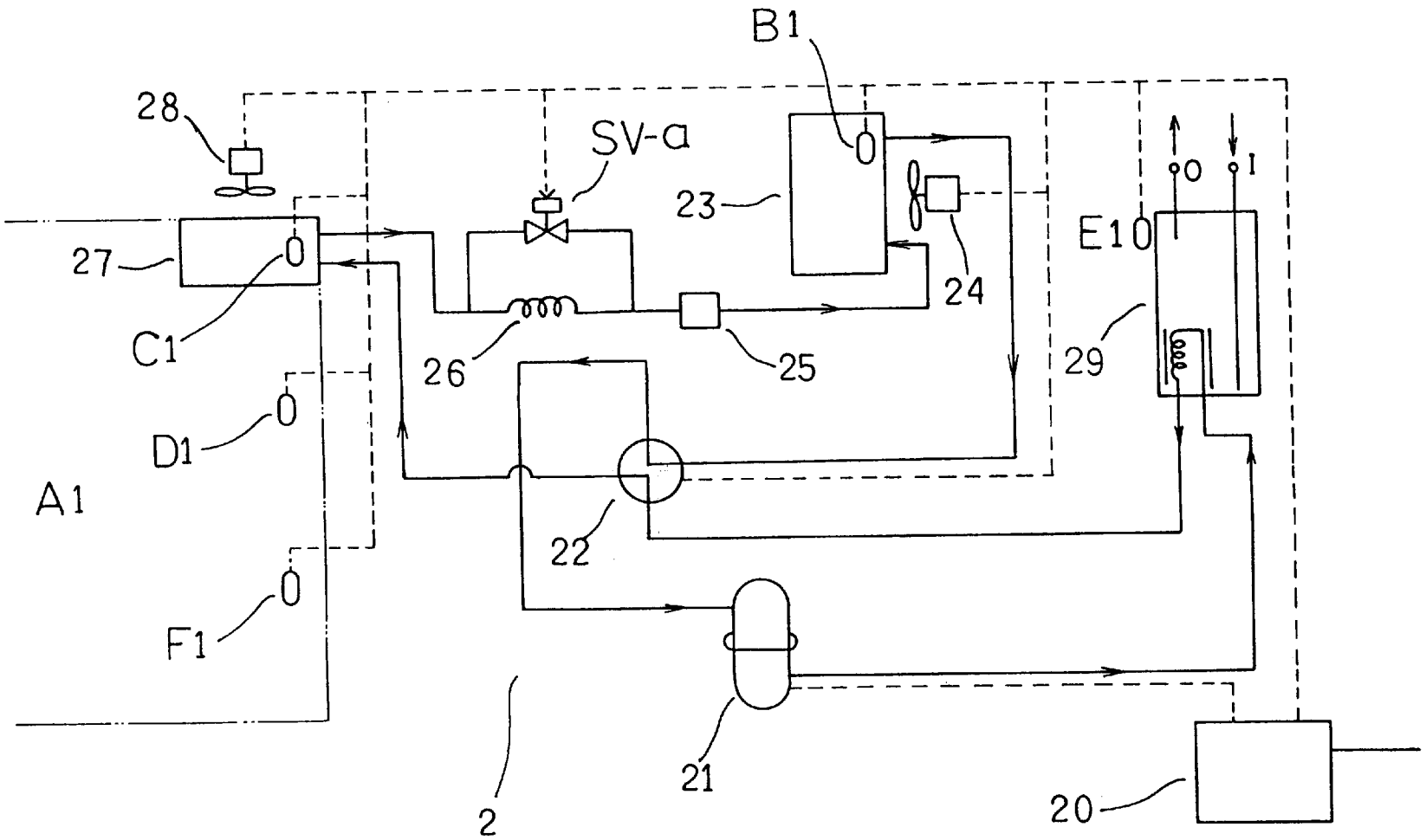
FIG. 3 is another schematic drawing of the first preferred embodiment shown in FIG. 2.

Referring to FIGS. 2 and 3, there is shown a first preferred embodiment of air conditioner/heater 2 constructed in accordance with the invention. The air conditioner/heater 2 is activated to air condition/heat a single room (i.e., enclosed space) A1. That is, this is one-to-one mode. Air conditioner/heater 2 comprises a compressor 21, a heat recovery device 29, a heat exchanger 23, a fan motor 24, a filter 25, and a coolant flow controller 26 (all above components are installed outside the enclosed space A1). Air conditioner/heater 2 further comprises a heat exchanger 27 and a fan motor 28 (all are installed indoors). The air conditioner/heater 2 is controlled by a central processing unit (CPU) 20 through associated components such as a directional-control valve 22, a defrost bypass valve SV-a, a plurality of sensors B1, C1, D1, and E1, and a control panel F1. With this system, it is possible to air condition, heat, or supply hot-water to the enclosed space A1 (FIG. 2). CPU 20 may compare sensed values Tie, Tic, Toe, Toc, and Ta obtained from sensors B1, C1, D1 and E1 with default values Ties, Tics, Toes, Tocs, and Tas. Accordingly, CPU 20 may control the on-off of compressor 21, the switch of directional-control valve 22 (i.e., switch between air conditioning and heating modes), the speed selections of fan motors 24 and 28, and the on-off of defrost bypass valve SV-a. Directional-control valve 22 may be switched to permit a specific coolant to flow through by the selection of air conditioning/heating mode (i.e., either in the case shown in FIG. 2 or FIG. 3). Sensors B1, C1, D1, and E1 are located on outdoor heat exchanger 23, indoor heat exchanger 27, enclosed space A1, and heat recovery device 29 respectively for sensing temperatures in order to obtain sensed values Tie, Tic, Toe, Toc, and Ta which are further sent to CPU 20. Control panel F1 is operable to set indoor temperature Tas and other functionalities. Defrost bypass valve SV-a is controlled by CPU 20 in the defrost cycle. Sensor B1 can sense the outlet temperature of outdoor heat exchanger 23 (i.e., sensed values Toe (evaporation temperature of heating cycle) and Toc (condensation temperature of air conditioning cycle)). Sensor C1 can sense the outlet temperature of indoor heat exchanger 27 (i.e., sensed values Tie (evaporation temperature of air conditioning cycle) and Tic (condensation temperature of heating cycle)). Sensor D1 can sense the ambient temperature of enclosed space A1 (i.e., sensed value Ta). Sensor E1 is located either inside or outside heat recovery device 29 for sensing the temperature thereof (i.e., sensed values Te). The corresponding relationship between sensed values Tie, Tic, Toe, Toc, Ta, and Te and default values Ties, Tics, Toes, Tocs, Tas, and Tes is as follows:

(1) In air conditioning cycle: Ta is corresponding to Tas, Tie is corresponding to Ties, Toc is corresponding to Tocs, and Te is corresponding to Tes.

(2) In heating cycle: Ta is corresponding to Tas, Tic is corresponding to Tics, Toc is corresponding to Tocs, and Te is corresponding to Tes.

As shown, heat recovery device 29 is provided between coolant outlet of compressor 21 and directional-control valve 22. Coil 291 is provided in heat recovery device 29 for effecting a heat exchange therein. That is, heat carried by coolant is transferred to cold water sent from cold water supply line I in coil 291. The thus formed hot-water is outputted to hot-water line O. The features of heat recovery device 29 is as follows:

1. Recover exhaust heat in air conditioning cycle.
2. In heating or hot-water making cycle, store the low temperature heat source absorbed by outdoor heat exchanger (e.g., evaporator) and increase the temperature of heat source by the activation of compressor.
3. Supply heat for defrost cycle.
4. Transfer heat to any of other places for fully utilizing the heat.

Also, heat recovery device 29 may recover heat from condensate. Thus, it is possible to optimize the performance of the system by the addition of heat recovery device 29.

Figure 4:
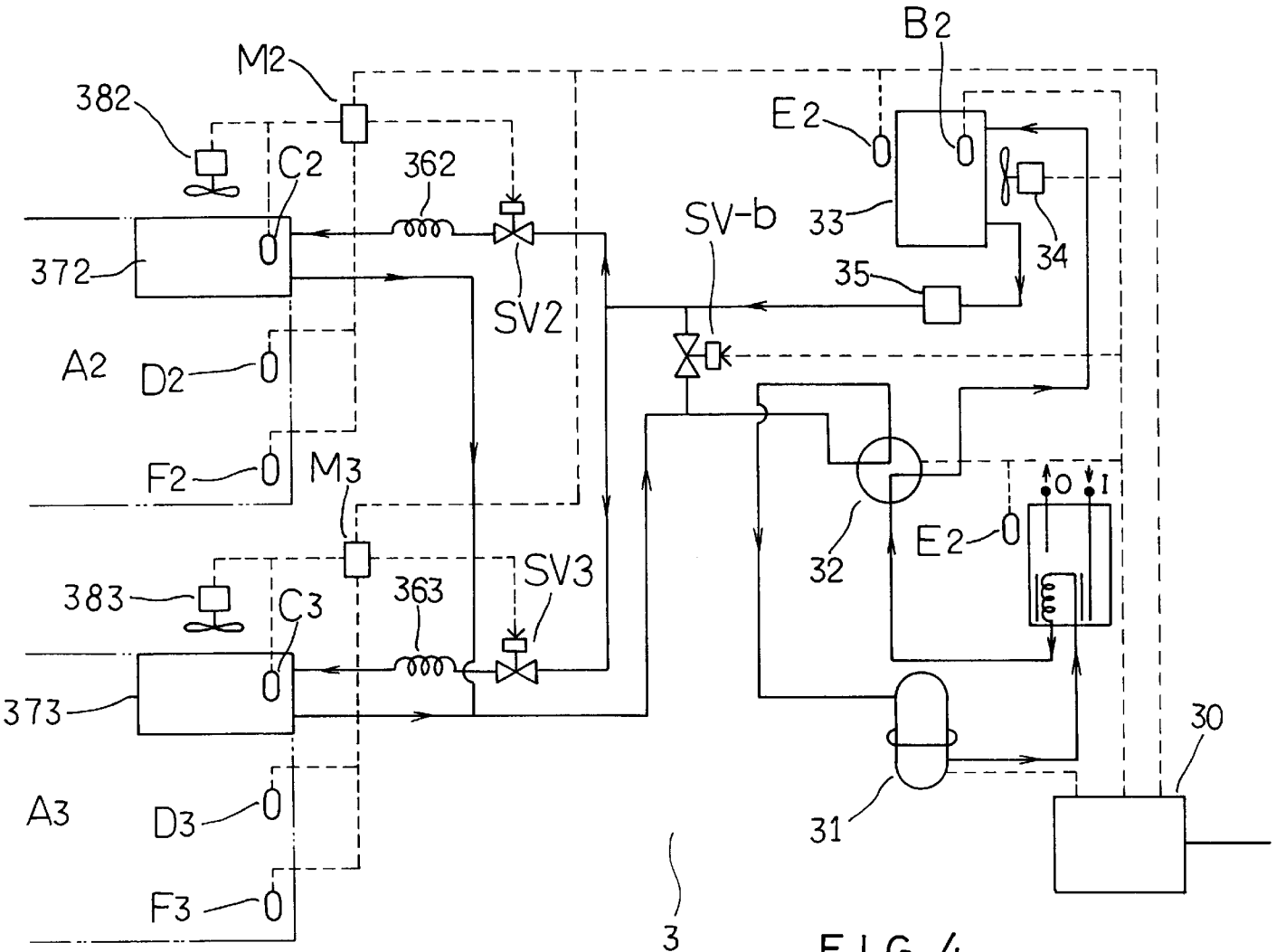
FIG. 4 is a schematic drawing of a second preferred embodiment of air conditioner/heater according to the invention.
Figure 5:
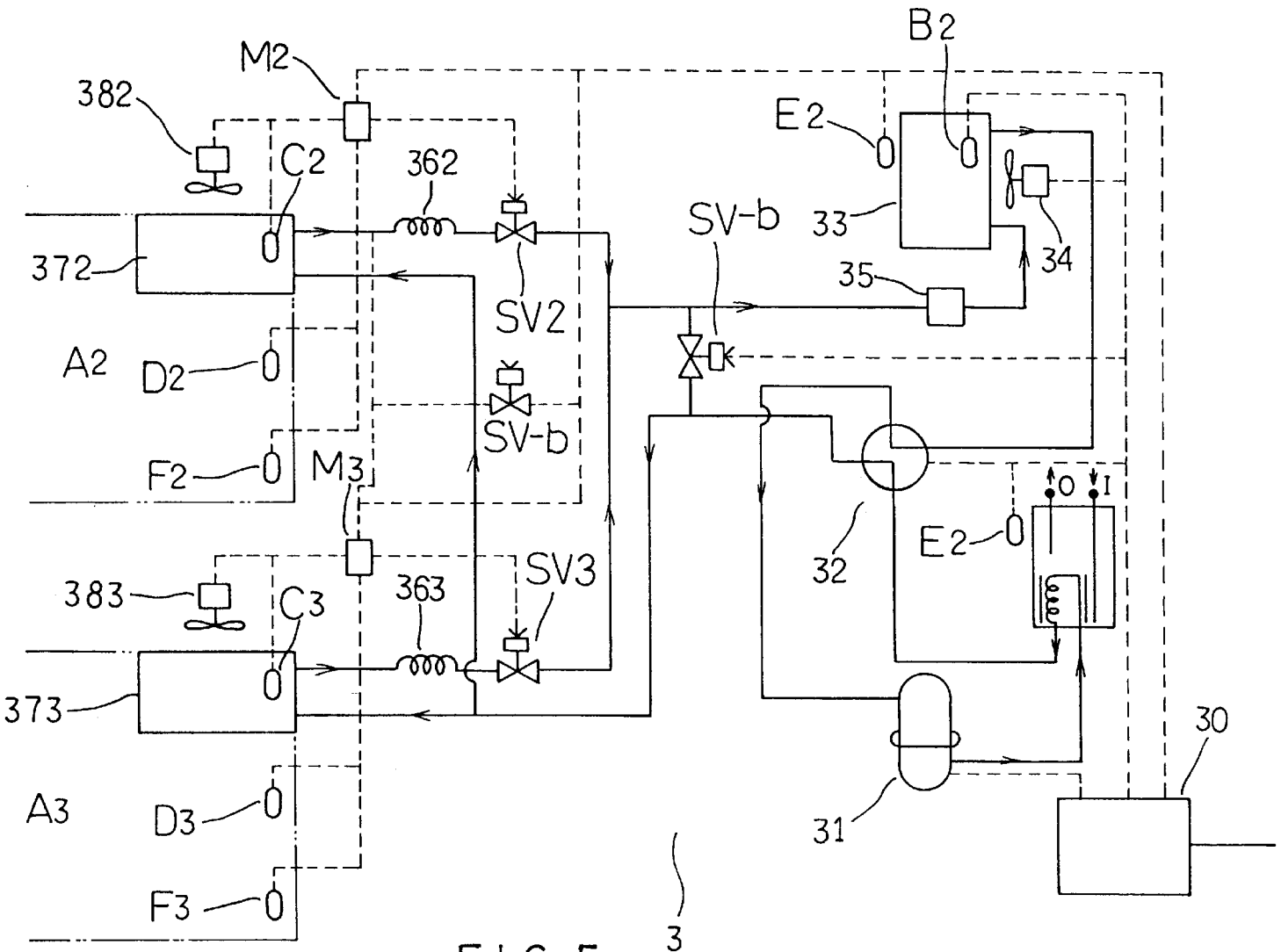
FIG. 5 is another schematic drawing of the second preferred embodiment shown in FIG. 4.

Referring to FIGS. 4 and 5, there is shown a second preferred embodiment of air conditioner/heater 3 constructed in accordance with the invention. The air conditioner/heater 3 is activated to air condition/heat a plurality of rooms. That is, this is an one-to-many mode. Air conditioner/heater 3 comprises a compressor 31, a heat recovery device 39, a heat exchanger 33, a fan motor 34, a filter 35, and a plurality of coolant flow controllers 362 and 363 (all above components are installed outside enclosed spaces A2 and A3). Air conditioner/heater 3 further comprises a plurality of heat exchangers 372 and 373 and a plurality of fan motors 382 and 383 (all are installed in the enclosed spaces A2 and A3 respectively). Similar to the first embodiment, the air conditioner/heater 3 is controlled by a CPU 30 through associated components such as a directional-control valve 32, a plurality of sensors B2, C2, C3, D2, D3, and E2, and a plurality of control panels F2 and F3. The differences between first and second embodiments are that the number of enclosed space is increased from one to more than one (e.g., A2, A3, . . . ,An wherein A2 and A3 are shown). Coolant flow controller 362 and solenoid-controlled valve SV2 are located on the path of coolant flow of enclosed space A2. Coolant flow controller 363 and solenoid-controlled valve SV3 are located on the path of coolant flow of enclosed space A3. Controls M2 and M3 are controlled by CPU 30 for controlling the corresponding enclosed spaces A2 and A3 respectively, i.e., CPU 30 may control the activation of sensors B2, C2, D2, C3, D3, and E2, the on-off of solenoid-controlled valves SV2 and SV3, and the operations of fan motors 382 and 383. Compressor 31 and defrost bypass valve SV-b are also controlled by CPU 30. Control panels F2 and F3 are operable to set indoor temperature Tas and other functionalities in enclosed spaces A2 and A3 respectively. Solenoid-controlled valves SV2 and SV3 are commanded to control the coolant flow into respective enclosed spaces A2 and A3. The relationship among enclosed spaces A2 and A3, controls M1 and M2, throttle valves K2 and K3, and solenoid-controlled valves SV2 and SV3 is as follows:

Control M2 and solenoid-controlled valve SV2 are located in enclosed space A2; and control M3 and solenoid-controlled valve SV3 are located in enclosed space A3. Ambient temperatures of enclosed spaces A2 and A3 (i.e., sensed values) are Ta2 and Ta3 respectively. The sensed values thereof are Tas2 and Tas3 respectively. The outlet temperatures in enclosed spaces A2 and A3 are Tie2 and Tie3 respectively in air conditioning cycle with a default value Ties. The outlet temperatures in enclosed spaces A2 and A3 are Tic2 and Tic3 respectively in heating cycle with a default value Tics. The outlet temperatures outside enclosed spaces A2 and A3 are Toe and Toc respectively with default values Toes and Tocs. The sensed temperature in heat recovery device 39 is Te with a default value Tes. The corresponding relationship between sensed values and default values of respective enclosed spaces is as follows:

A: Ta is corresponding to Tas, Tie is corresponding tc Ties, and Tic is corresponding to Tics;

A2: Ta2 is corresponding to Tas2, Tie2 is corresponding to Ties, and Tic2 is corresponding to Tics;

A3: Ta3 is corresponding to Tas3, Tie3 is corresponding to Ties, and Tic3 is corresponding to Tics;

Toe is corresponding to Toes;

Te is corresponding to Tes; and

Toc is corresponding to Tocs.

Figure 6:
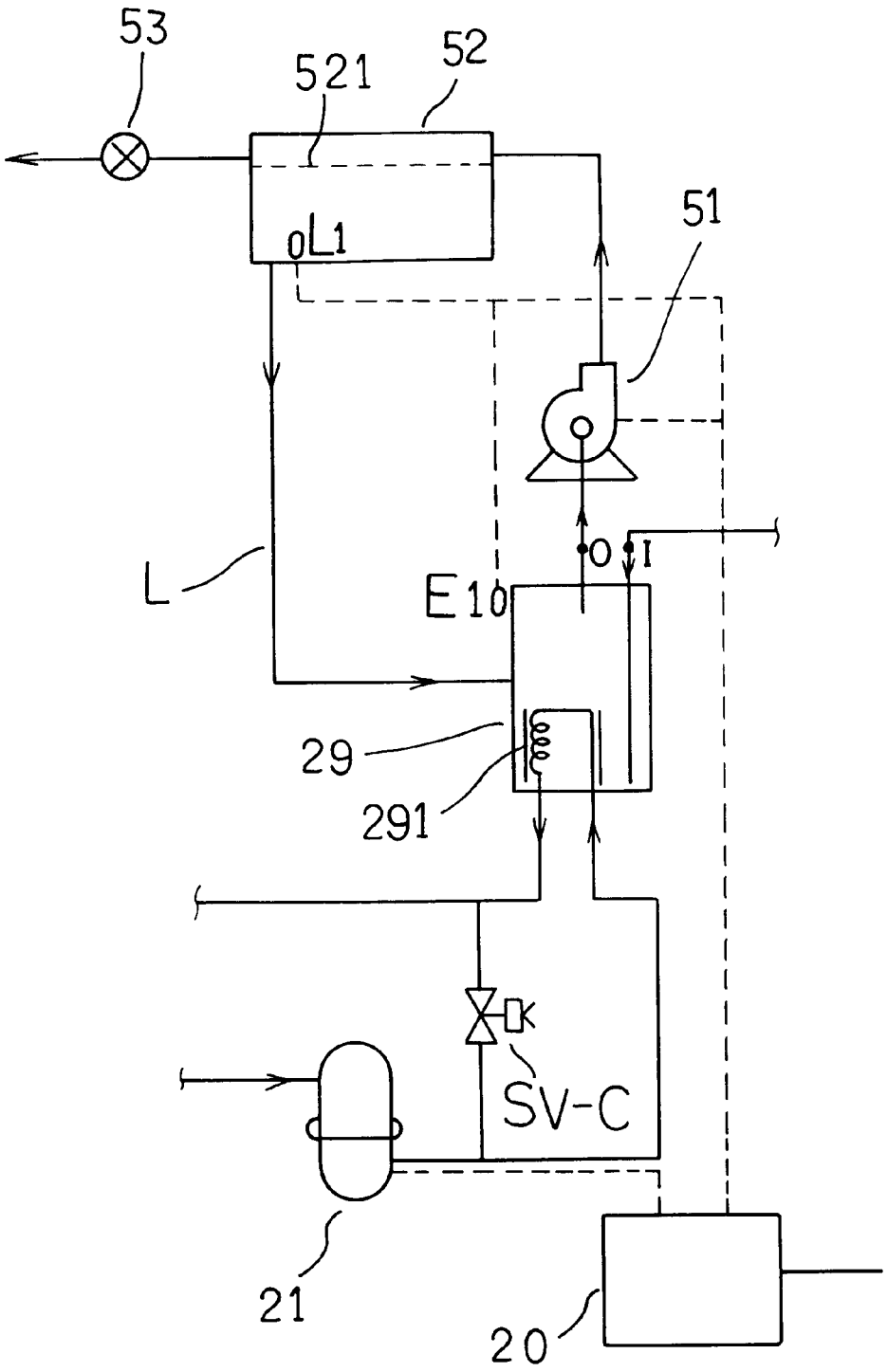
FIG. 6 is a schematic drawing of heat recovery device shown in FIGS. 2 to 5.

Referring to FIG. 6, a detailed diagram of heat recovery device 29 is shown. Water pump 51 is provided on hot-water line O for pumping hot-water to temporarily store in hot-water reservoir 52. A baffle plate 521 and a sensor L1 are provided in hot-water reservoir 52. A check valve 53 serves to control the on/off of hot-water output. An overflow pipe L is at the bottom of hot-water reservoir 52. The on/off of pump 51 is controlled by CPU 20. When a temperature value Tf of hot-water reservoir 52 sensed by sensor L1 is lower than a temperature value Te of heat recovery device 29 sensed by sensor E1 (i.e., Tf<Te−X1), pump 51 is activated (ON). Otherwise, if Tf≧Te−X2 and X1>X2, pump 51 is deactivated (OFF). The joint of overflow pipe L and heat recovery device 29 is above coil 291 within heat recovery device 29 so as to transfer hot-water back to heat recovery device 29 when hot-water supplying is cut off. This hot-water feedback cycle can substantially maintain the temperature of heat recovery device 29 at a constant value.

A bypass line is connected between coolant outlet pipe of compressor 21 and coolant outlet pipe of heat recovery device 29. A bypass valve SV-c is provided on the bypass line. In air-conditioning cycle, if Te>Tes+Y (Y is a default offset), bypass valve SV-c is open to form a bypass. Note that the temperature of hot-water in heat recovery device 29 is higher than default offset Y at this time. Hence, coolant is blocked from entering heat recovery device 29 since there is no need for heat exchange. If Te<Tes, it means that the temperature of hot-water is lower than temperature default offset Y. Hence, bypass valve SV-c is closed. As a result, coolant is permitted to enter heat recovery device 29 for transferring heat in order to make hot-water therein. In heating cycle, Te>Tes+Y and Tic<Tics, it means that indoor temperature is lower than predetermined temperature. Thus, heating in closed space(s) is necessary. Hence, bypass valve SV-c is closed. As a result, coolant is permitted to enter heat recovery device 29 for preheating. If Te<Tes−Z (Z is a default offset), it means that the temperature of hot-water is lower than predetermined temperature. Hence, bypass valve SV-c is open to form a bypass so as to directly supply heat to enclosed space(s).

Figure 7:
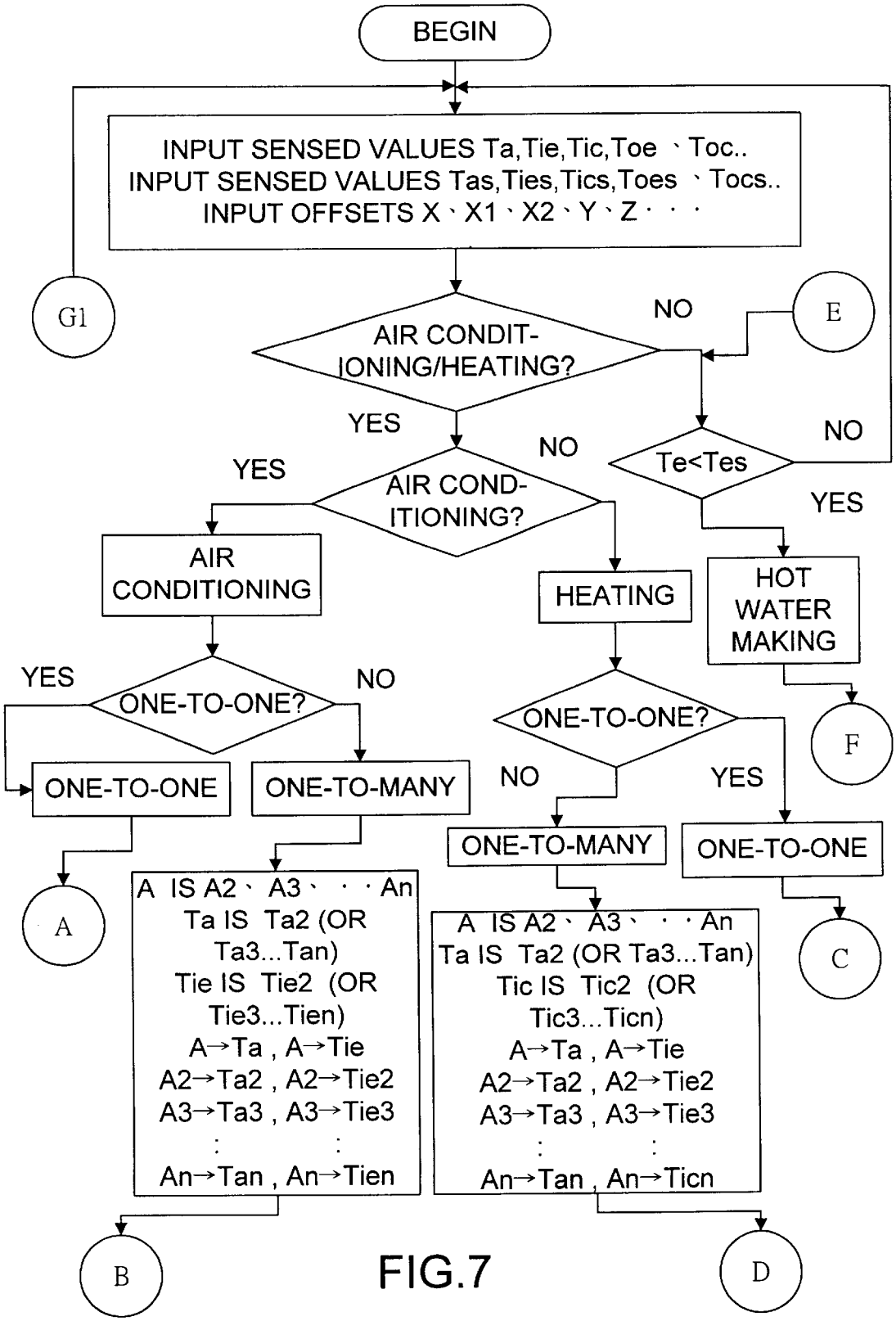
FIG. 7 is a first flow chart of the control process of the invention.

Referring to FIGS. 7 to 12 in conjunction with FIGS. 13 to 22, flow charts of the control processes of first to second embodiments of the invention will now be described in detail. In FIG. 7 sensed values Ta, Tie, Tic, Toe, Toc, and Te obtained from sensors B1, B2, B3, C1, C2, C3, D1, D2, D3, E1, and E2 are sent to CPU 20 (or 30) for comparison with default values Tas, Ties, Tics, Toes, Tocs, and Tes. Then a determination is made whether it is in air conditioning or heating cycle. If air conditioner/heater is neither in air conditioning nor in heating cycle, process goes to a next step to determine whether Te<Tes. If the result is positive, the process is in a hot-water making cycle and the process jumps to F (FIG. 12), otherwise stop the indoor fan motors 28, 382 and 383 and process loops back to the beginning. If air conditioner/heater is in either air conditioning or heating cycle, the process goes to a next step for determining whether the system has switched to air conditioning cycle. If yes, process goes to air conditioning cycle, otherwise process goes to heating cycle. Next, a determination is made whether process is one-to-one or one-to-many with respect to respective cycles (i.e., air conditioning cycle and heating cycle). Then process goes to A, B, C, or D corresponding to one of FIGS. 8 to 11 based on the result of above determination.

Figure 12:
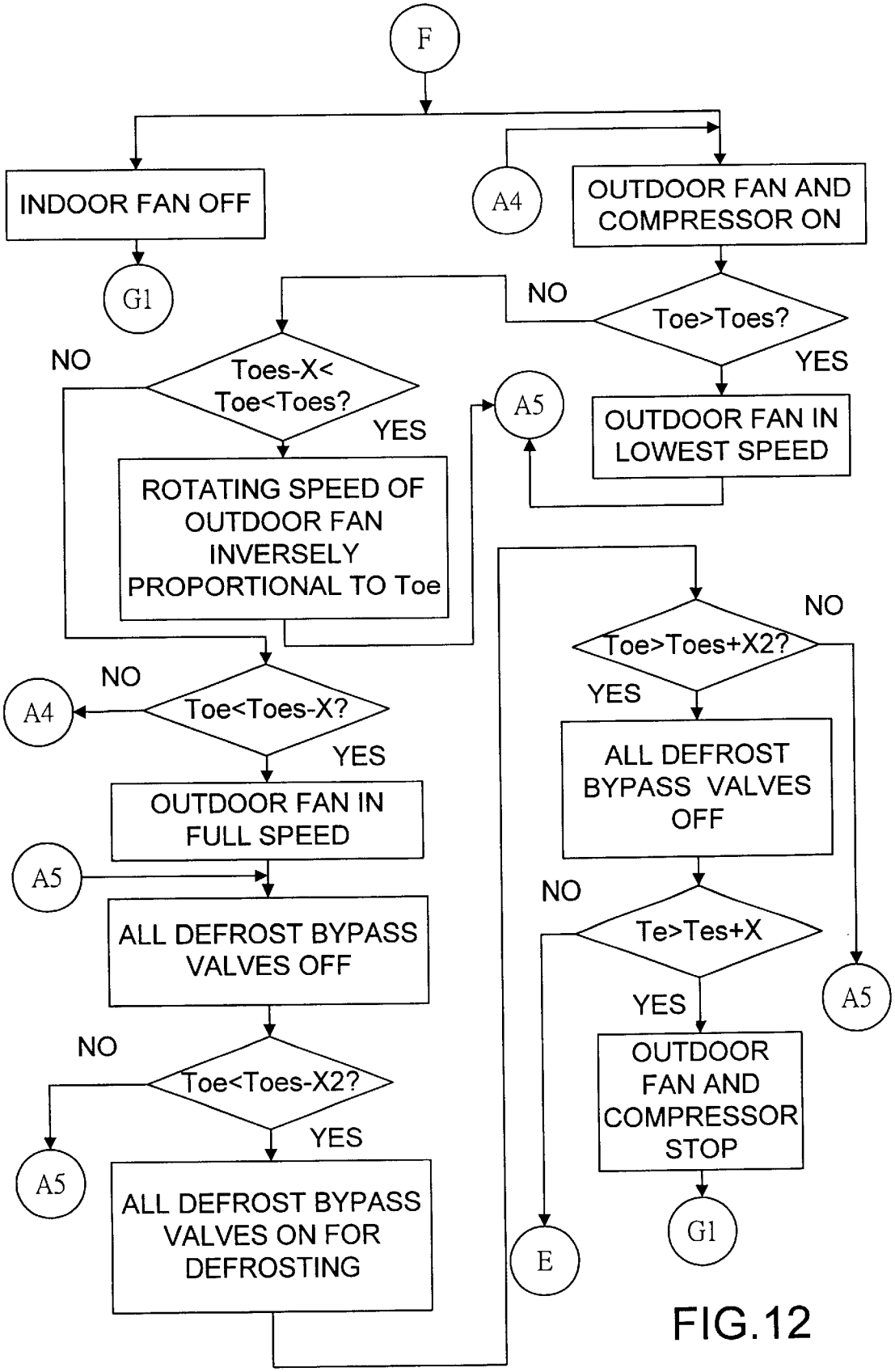
FIG. 12 is a sixth flow chart of the control process of the invention.
Figure 14:
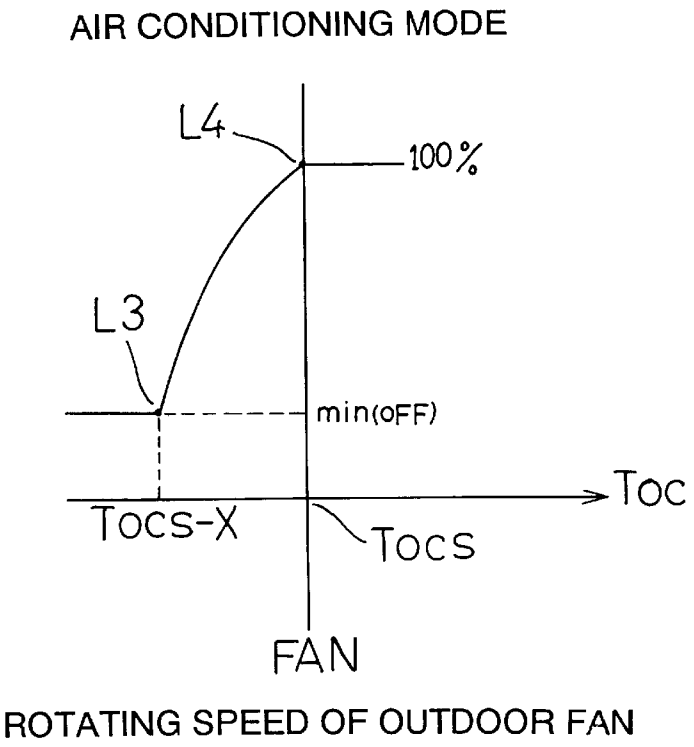
FIG. 14 is a graph illustrating the rotating speed of outdoor fan motor versus temperature in air conditioning mode.
Figure 13:
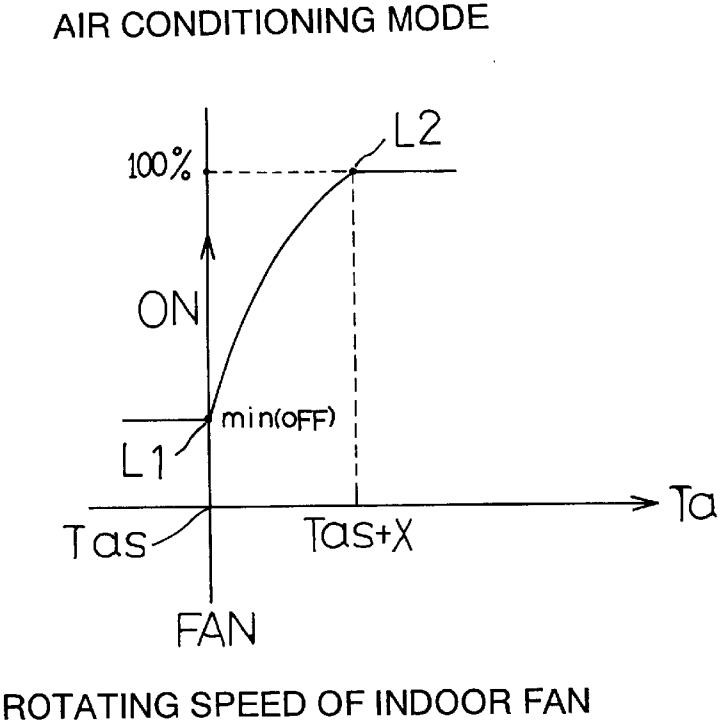
FIG. 13 is a graph illustrating the rotating speed of indoor fan motor versus temperature in air conditioning mode.
Figure 16:
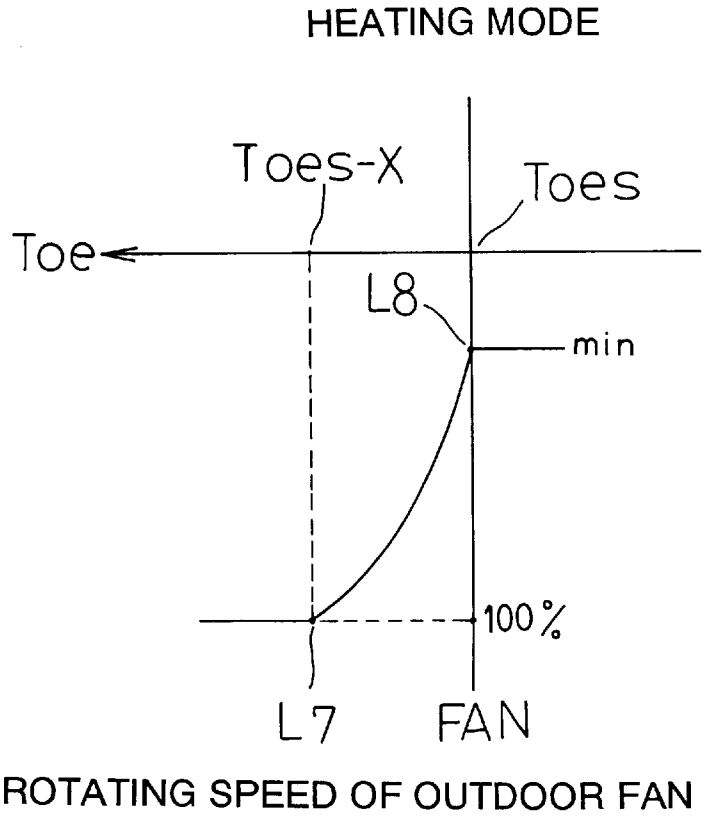
FIG. 16 is a graph illustrating the rotating speed of outdoor fan motor versus temperature in heating mode.
Figure 15:
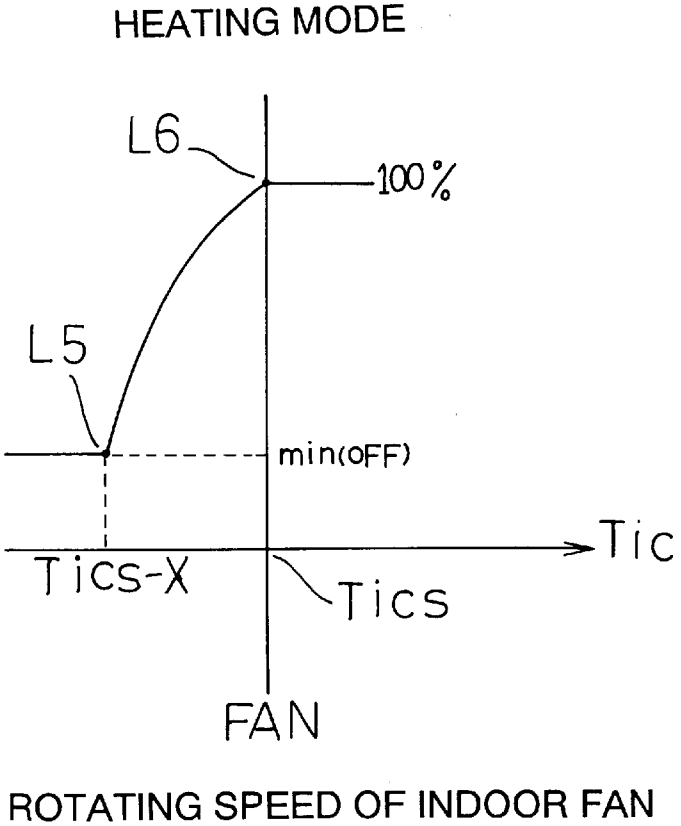
FIG. 15 is a graph illustrating the rotating speed of indoor fan motor versus temperature in heating mode.
Figure 17:
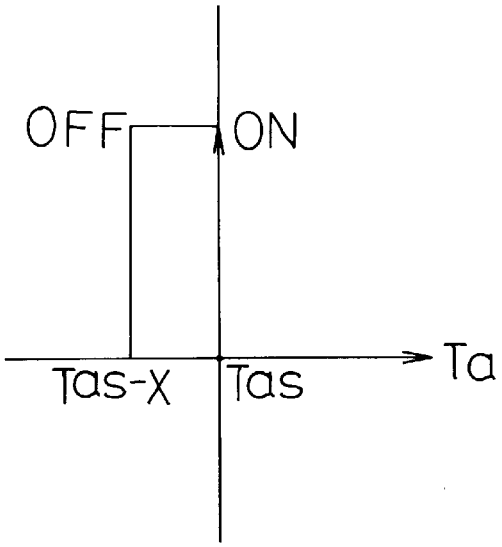
FIG. 17 is a first graph illustrating the operation of compressor.
Figure 18:
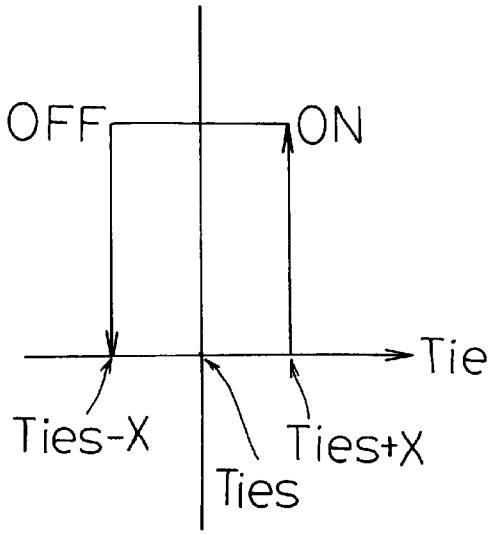
FIG. 18 is a second graph illustrating the operation of compressor.
Figure 19:
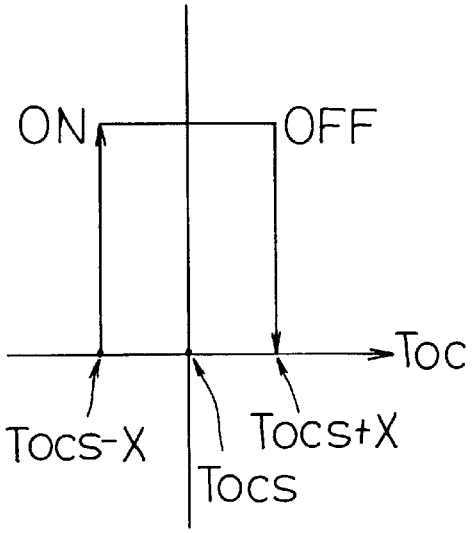
FIG. 19 is a third graph illustrating the operation of compressor.
Figure 20:
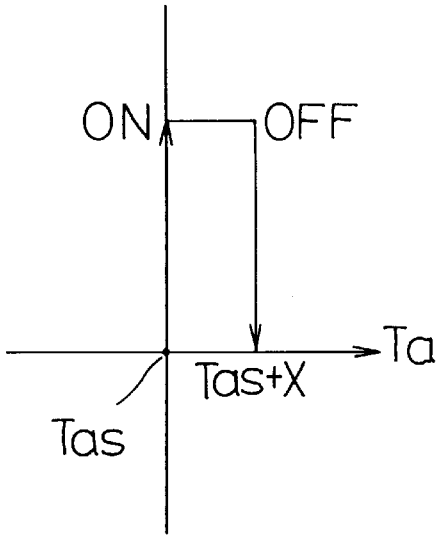
FIG. 20 is a fourth graph illustrating the operation of compressor.
Figure 21:
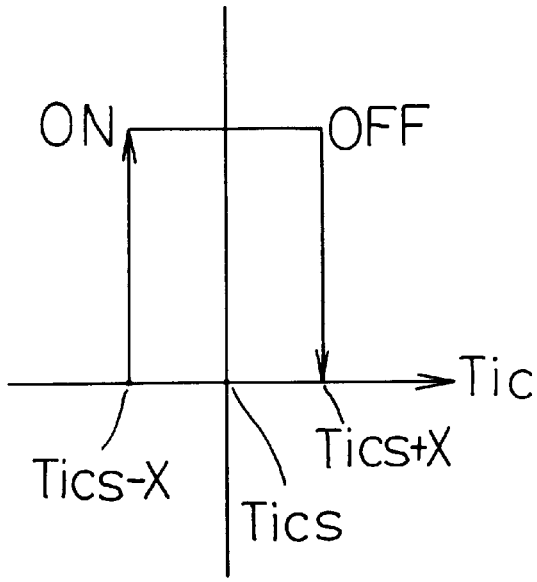
FIG. 21 is a fifth graph illustrating the operation of compressor.
Figure 22:
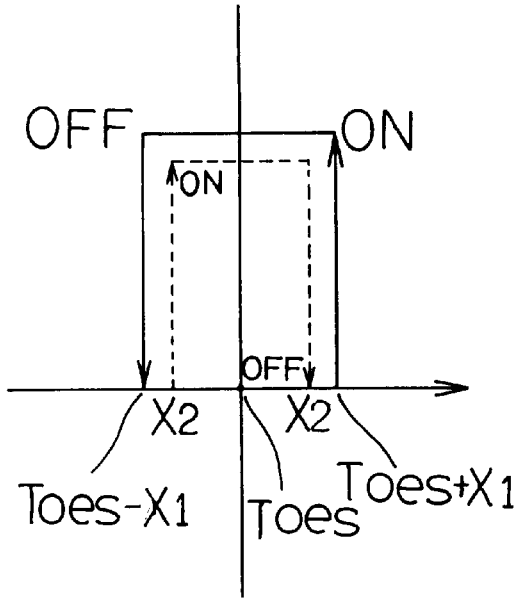
FIG. 22 is a sixth graph illustrating the operation of compressor.

Following is a detailed description of hot-water making operation of the invention (see FIG. 12). First, activate outdoor fan motors 28 and 38 and compressors 21 and 41. If Toe>Toes, outdoor fan motors 24 and 34 operate in lowest speed; otherwise, if Toes−X<Toe<Toes, the rotating speeds of outdoor fan motors 24 and 34 are inversely proportional to Toe; otherwise, if Toe<Toes−X, outdoor fan motors 24 and 34 operate in full speed; otherwise, the process loops back to the beginning of F. Then close defrost bypass valves SV-a and SV-b. If Toe<Toes−X2 (X2 is a second default offset), close defrost bypass valves SV-a and SV-b for defrosting; otherwise continue to close defrost bypass valves SV-a and SV-b. If Toe>Toes+X2, close defrost bypass valves SV-a and SV-b for stopping the defrost cycle. If Te>Tes+X, outdoor fan motors 24 and 34 and compressors 21 and 31 stop since the temperature of hot-water has reached a predetermined value. The process loops back to G (FIG. 7).

Following is a detailed description of air conditioning operation of the invention wherein switch valves 22 and 32 have switched to air conditioning cycle.

Figure 8A:
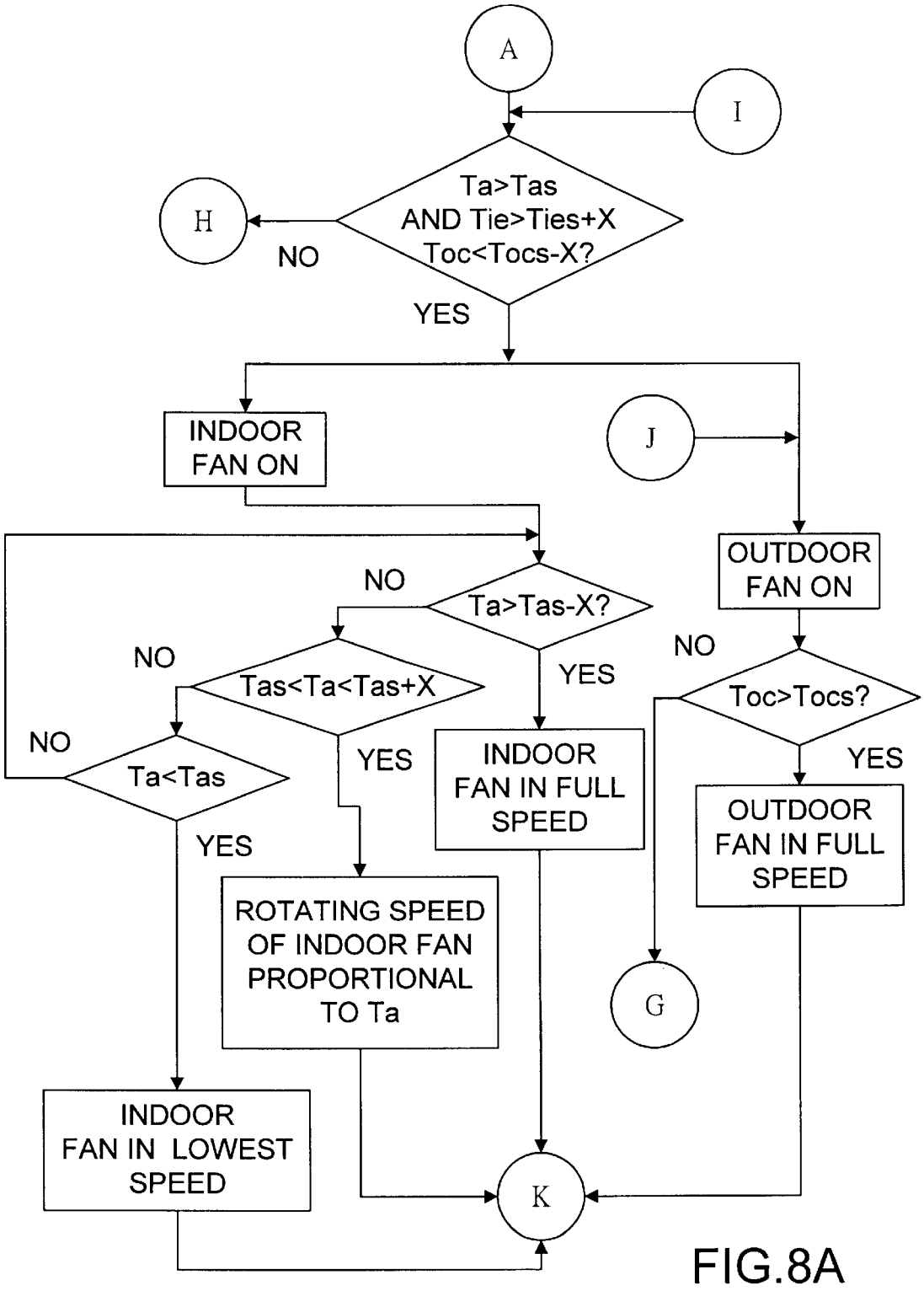
FIG. 8 is a second flow chart of the control process of the invention.
Figure 8B:
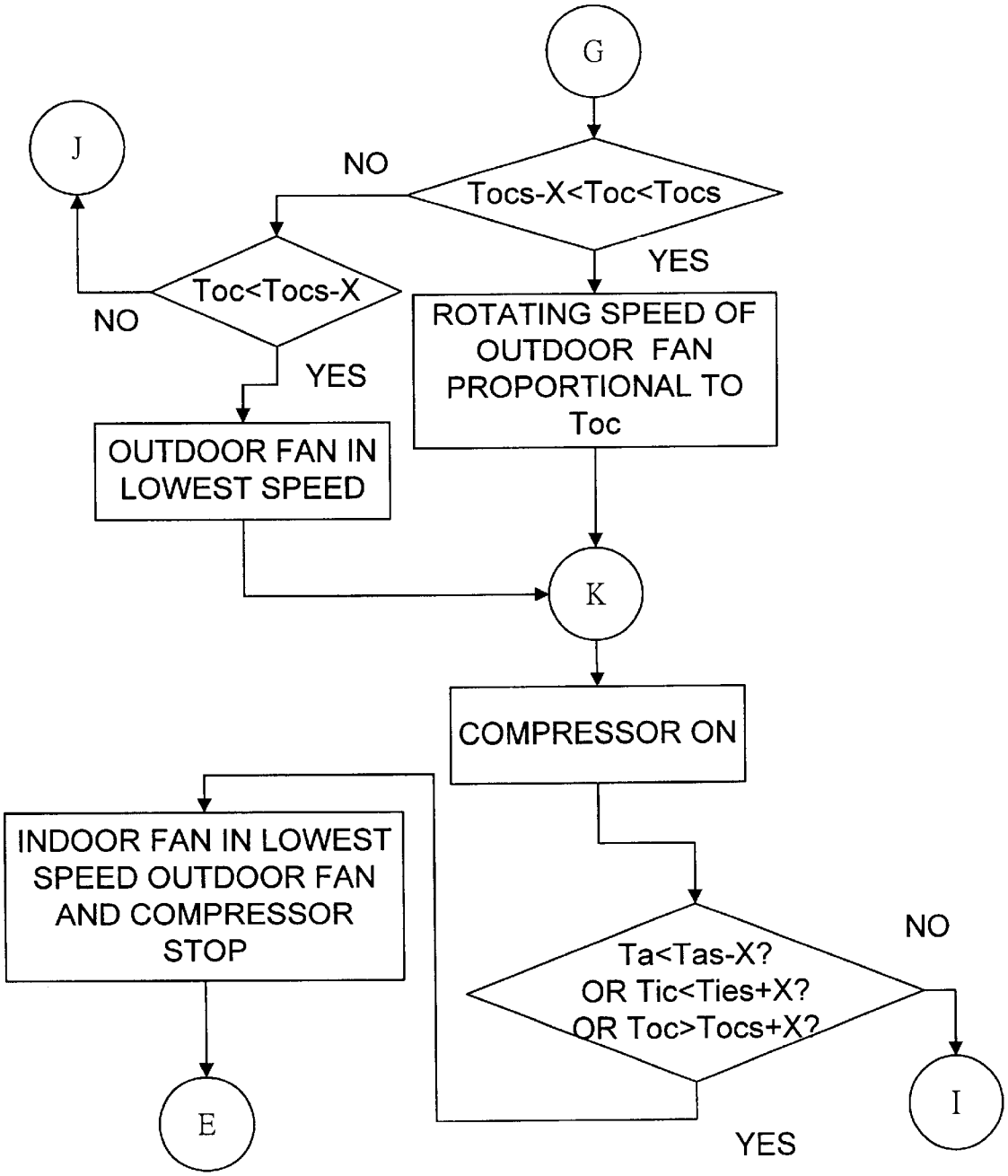

One-to-one Operation Mode (See FIGS. 2 and 8)

When ambient temperature of enclosed space Al (i.e., sensed value Ta) is larger than Tas (i.e., Ta>Tas), outlet temperature (i.e., sensed value Tie) of indoor heat exchanger (as an evaporator) 27 is larger than Ties plus X (i.e., Tie>Ties+X), and outlet temperature (i.e., sensed value Toc) of indoor heat exchanger (as a condenser) 23 is smaller than Tocs minus X (i.e., Toc<Tocs X), both indoor fan motor 28 and outdoor fan motor 24 start to operate; otherwise the process jumps to last step in FIG. 8. When indoor fan motor 28 is operating, if Ta>Tas+X, indoor fan motor 28 operates in full speed; otherwise, if Tas<Ta<Tas+X, the rotating speed of indoor fan motor 28 is proportional to Ta (as indicated by line L1–L2 in FIG. 13); otherwise, if Ta<Tas, the rotating speed of indoor fan motor 28 is lowest. At the same time when outdoor fan motor 24 is operating, if Toc>Tocs, outdoor fan motor 24 operates in full speed; otherwise, if Tocs−X<Toc<Tocs, the rotating speed of outdoor fan motor 24 is proportional to Toc (as indicated by line L3–L4 in FIG. 14); otherwise, if Toc<Tocs−X, the rotating speed of outdoor fan motor 24 is lowest (or even stops). Next compressor 21 activates (ON) (see FIGS. 17 to 22). Then the process determines whether Ta<Tas−X, Tie<Ties−X, or Toc>Tocs+X. If yes, indoor fan motor 28 operates in lowest speed (or even stops), outdoor fan motor 24 and compressor 21 stop (OFF). If not, the process loops back to the beginning of FIG. 8.

Figure 9A:
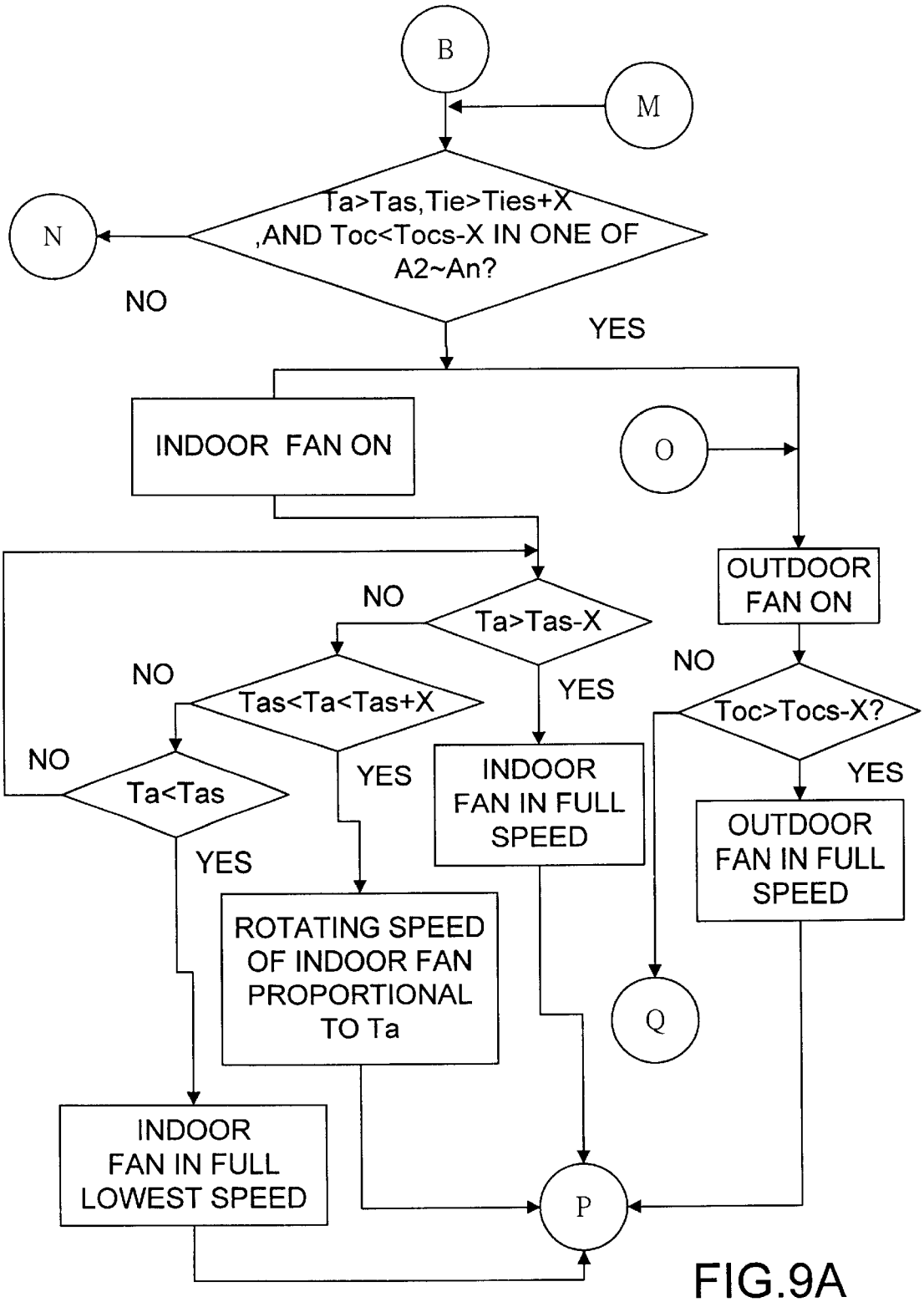
FIG. 9 is a third flow chart of the control process of the invention.
Figure 9B:
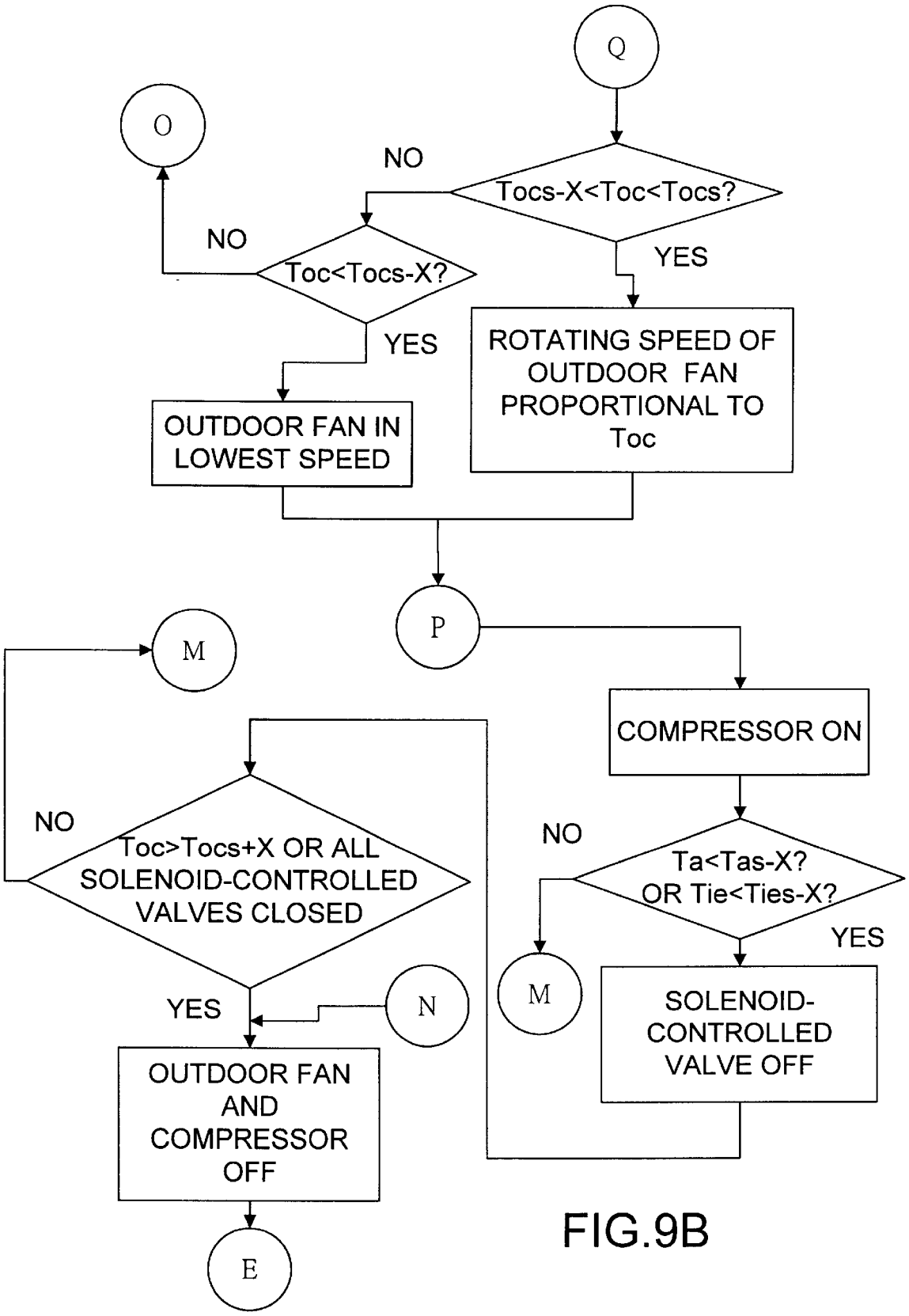

One-to-many Operation Mode (See FIGS. 4 and 9)

(A) When ambient temperature of any of enclosed spaces A2 and A3 (i.e., sensed value Tan) is larger than Tas (i.e., Tan>Tas), Tien>Ties+X, and Toc<Tocs−X (where n is 2 or 3), both indoor fan motor 382 (or 383) and outdoor fan motor 24 start to operate; otherwise the process jumps to last step in FIG. 9. When indoor fan motor 382 (or 383) is operating, if Ta>Tas+X, indoor fan motor 382 (or 383) operates in full speed; otherwise, if Tas<Ta<Tas+X, the rotating speed of indoor fan motor 382 (or 383) is proportional to Ta (as indicated by line L1–12 in FIG. 13); otherwise, if Ta<Tas, the rotating speed of indoor fan motor 382 (or 383) is lowest. At the same time when outdoor fan motor 34 is operating, if Toc>Tocs, outdoor fan motor 34 operates in full speed; otherwise, if Tocs−X<Toc<Tocs, the rotating speed of outdoor fan motor 34 is proportional to Toc (as indicated by line L3–L4 in FIG. 14); otherwise, if Toc<Tocs−X, outdoor fan motor 34 operate in lowest speed (or even stop). Next compressor 31 activates (ON) (see FIGS. 17 to 22). Then the process determines whether Ta<Tas−X or Tie<Ties−X. If yes, solenoid-controlled valve SV2 (or SV3) is closed; otherwise, the process loops back to the beginning of FIG. 9. The process then determines whether Toc>Tocs+X or all solenoid-controlled valves SV2 and SV3 are closed. If not, the process loops back to the beginning of FIG. 9. If yes, outdoor fan motor 34 and compressor 31 stop (OFF).

Following is a detailed description of heating operation of the invention wherein switch valves 22 and 32 have switched to heating cycle.

Figure 10A:
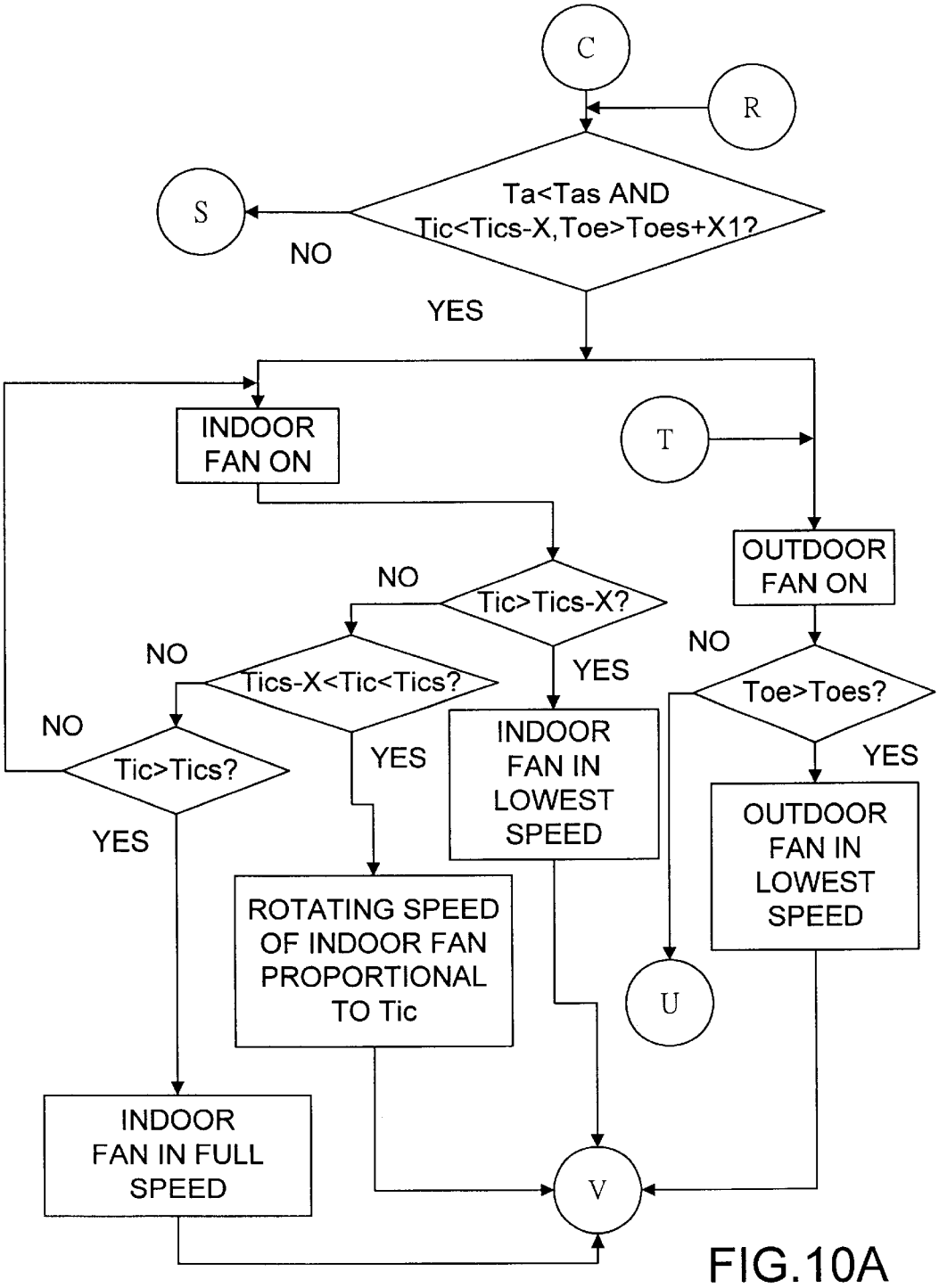
FIG. 10 is a fourth flow chart of the control process of the invention.
Figure 10B:
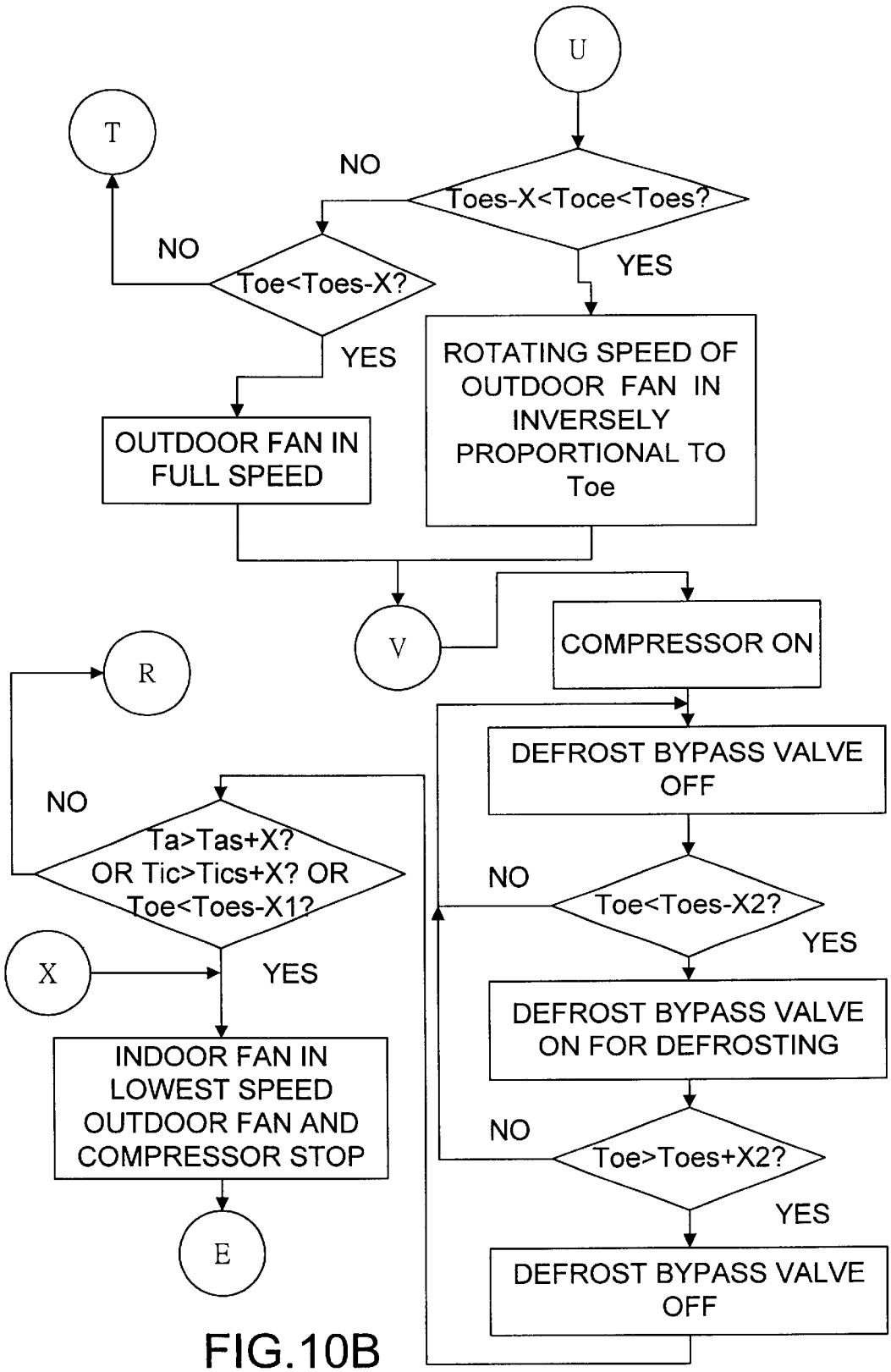

One-to-one Operation Mode (See FIGS. 3 and 10)

If ambient temperature of enclosed space Al (i.e., sensed value Ta) is smaller than Tas (i.e., Ta<Tas), the outlet temperature of indoor heat exchanger (as evaporator) 27 (i.e., sensed value Tic) is smaller than Tics minus default offset X (i.e., Tic<Tics−X, and the outlet temperature of outdoor heat exchanger (as condenser) 23 (i.e., sensed value Toc) is larger than default value Toes plus a first default offset X1 (i.e., Toe>Toes+X1), in case (a) indoor fan motor 28 starts to operate. If Tic<Tics−X, indoor fan motor 28 operates in lowest speed (or even stops). If Tics−X<Tic<Tics, the rotating speed of indoor fan motor 28 is proportional to Tic (as represented by line L5–L6 in FIG. 15). If Tic>Tics, indoor fan motor 28 operates in full speed; and in case (b) outdoor fan motor 24 starts to operate. If Toe>Toes, outdoor fan motor 24 operates in lowest speed. If Toes−X<Toe<Toes, the rotating speed of outdoor fan motor 24 is inversely proportional to Toe (as represented by line L7–L8 in FIG. 15). If Toe<Toes−X, outdoor fan motor 24 operates in full speed. Then compressor 21 begins to operate as fan motors 24 and 28 operate (FIGS. 17 to 22), while defrost bypass valves SV-a is off. If Toe<Toes−X2 (where X2 is a second default offset), defrost bypass valves SV-a is turned on (ON) to enter into defrost cycle (as represented by dashed line X2-X2 in FIG. 22). If Toe>Toes+X2, defrost bypass valve SV-a is off. If Ta>Tas+X, Tic>Tics+X, or Toe<Toes−X1, indoor fan motor 28 operates in lowest speed (or even stop), outdoor fan motors 24 stops, and compressor 21 stops (OFF).

Figure 11A:
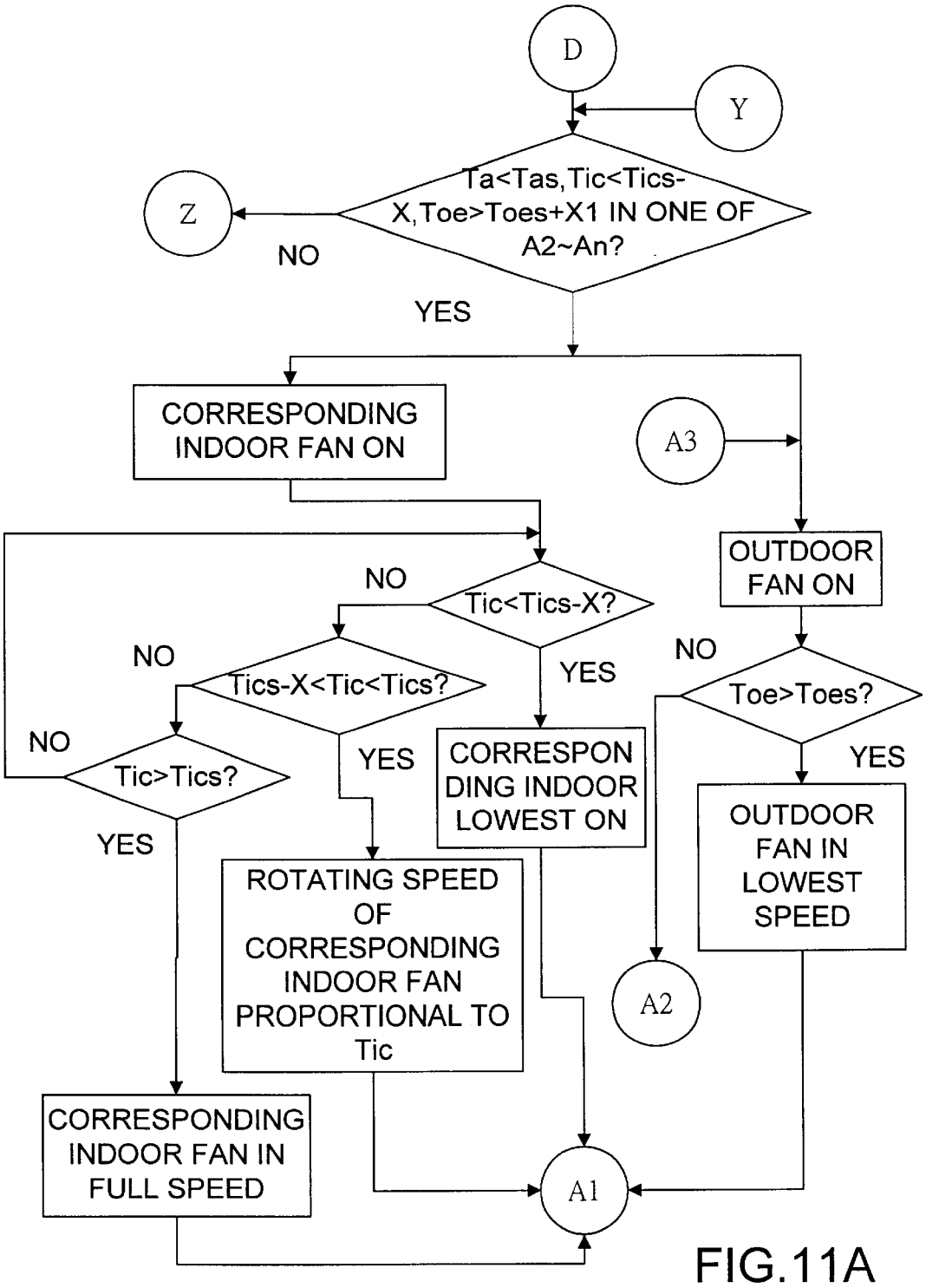
FIG. 11 is a fifth flow chart of the control process of the invention.
Figure 11B:
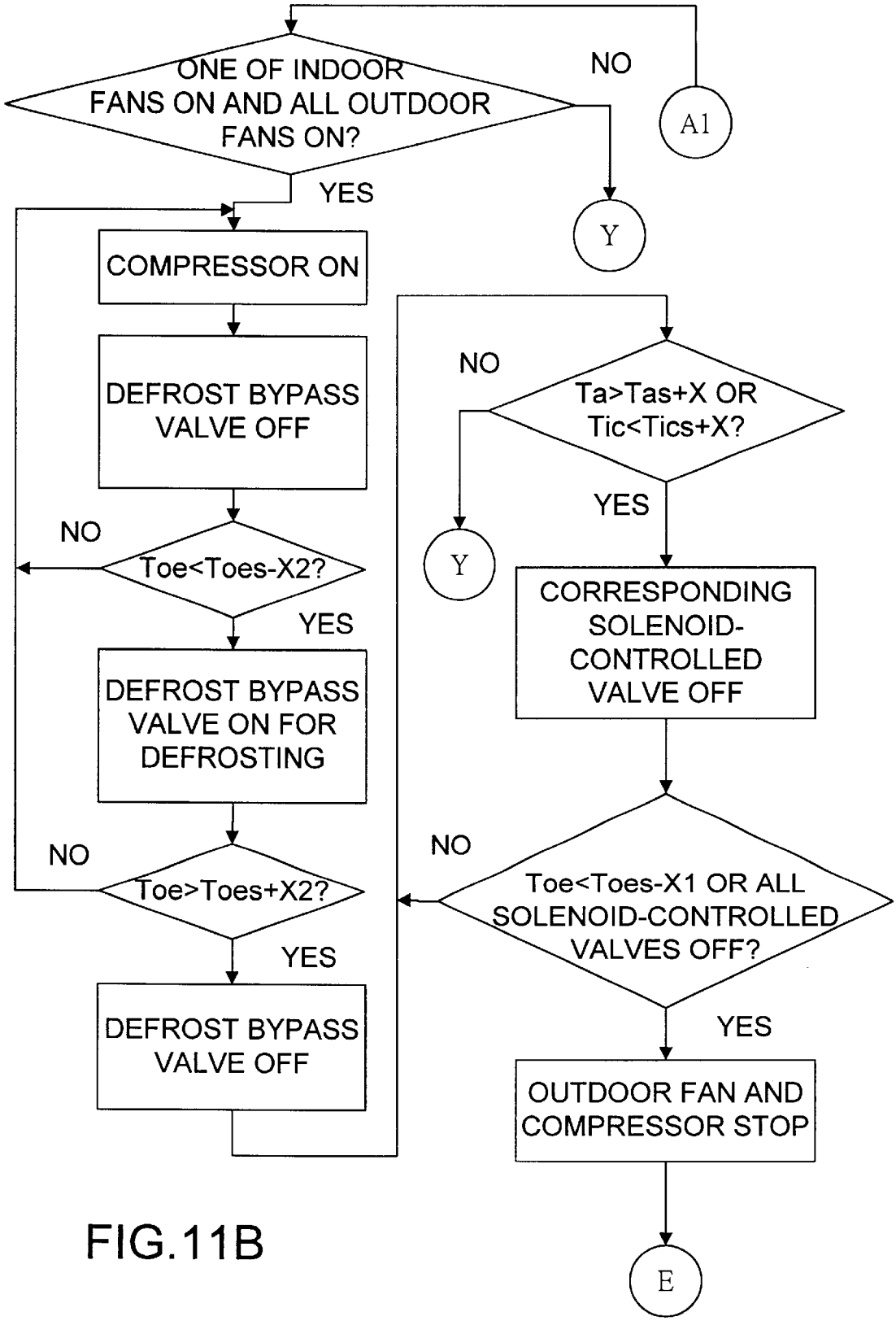

One-to-many Operation Mode (See FIGS. 5 and 11)

If ambient temperature of any of enclosed spaces A2 and A3 (i.e., sensed value Ta2 or Ta3) is larger than Tas (i.e., Ta2<Tas or Ta3<Tas), the corresponding indoor outlet temperature (sensed value Tic2 or Tic3) is smaller than default value Tics minus default offset X (i.e., Tic2<Tics−X or Tic3<Tics−X), and Toe>Toes+X11, in case (a) indoor fan motor 382 (or 383) corresponding to enclosed space A2 (or A3) starts to operate. If Tic<Tics−X, indoor fan motor 382 (or 383) operates in lowest speed (or even stops). If Tics−X<Tic<Tics, the rotating speed of indoor fan motor 382 (or 383) is proportional to Tic (as represented by line L5–L6 in FIG. 15). If Tic>Tics, indoor fan motor 382 (or 383) operates in full speed; and in case (b) outdoor fan motor 34 starts to operate. If Toe>Toes, outdoor fan motor 34 operates in lowest speed. If Toes−X<Toe<Toes, the rotating speed of outdoor fan motor 34 is inversely proportional to Toe (as represented by line L7–L8 in FIG. 16). If Toe<Toes−X, outdoor fan motor 34 operates in full speed. Compressor 31 begin to operate as indoor fan motor 382 (or 383) operates and outdoor fan motor 34 operate (FIGS. 17 to 22), while defrost bypass valves SV2 (or SV3) is open and defrost bypass valve SV-b is closed. If Toe<Toes−X2, defrost bypass valve SV-b is turned on (ON) to enter into defrost cycle (as represented by dashed line X2—X2 in FIG. 22). If Toe>Toes+X2, defrost bypass valve SV-b is turned off (OFF). If Ta>Tas+X or Tic>Tics+X, the corresponding solenoid-controlled valve SV2 (or SV3) is turned off. If Toe<Toes−X1, or all solenoid-controlled valves SV2 and SV3 are turned off, outdoor fan motor 34 and compressor 31 stop (OFF).

In brief, the air conditioner/heater of the invention can automatically operate in one of air conditioning, heating, and hot-water supplying modes by outlet temperatures of indoor and outdoor heat exchangers. With this, the operation of the air conditioner/heater is maintained at an optimum, resulting in an increase of operational efficiency as well as energy saving.

While the invention herein disclosed has been described by means of specific embodiments, numerous modifications and variations could be made thereto by those skilled in the art without departing from the scope and spirit of the invention set forth in the claims.

What is claimed is:

1. An apparatus for making hot-water by an air conditioner/heater, said apparatus comprising an outdoor section including a compressor, a heat recovery means, a heat exchanger, a fan motor, a filter, and a coolant flow controller; an indoor section including a heat exchanger and a fan motor; and a control section for air conditioning, heating, or supplying hot-water to an enclosed space, said control section including a central processing unit (CPU), a directional-control valve, a defrost bypass valve, a plurality of sensors, and a control panel wherein said CPU is operable to compare a plurality of sensed values obtained from said sensors with a plurality of predetermined values, control on-off of said compressor, switch of said directional-control valve, speed selections of said fan motors, and on-off of said defrost bypass valve, said directional-control valve is switched to permit a predetermined coolant to flow through by a selection of an air conditioning or heating mode, said sensors are located on said heat exchanger of said outdoor section, said heat exchanger of said indoor section, said enclosed space, and said heat recovery means respectively for sensing temperatures including outlet temperatures of said heat exchangers of said outdoor and indoor sections, an ambient temperature of said enclosed space, and an temperature of said heat recovery means, said heat recovery means comprises a coil with said coolant flowing through for exchanging heat, further comprising a cold water supply line, a hot-water line both in fluid communication with said heat recovery means, a water pump on said hot-water line, a hot-water reservoir on said hot-water line, the hot-water reservoir having a baffle plate and a sensor, a check valve for controlling output from said hot-water reservoir, and an overflow pipe extended from said bottom of said hot-water reservoir to a predetermined position above said coil in said heat recovery means for transferring hot-water back to said heat recovery means when said check valve is turned off.

2. The apparatus of claim 1, further comprising a bypass line connected between a coolant outlet of said compressor and a coolant outlet of said heat recovery means and a bypass valve on said bypass line wherein on/off of said bypass valve is adapted to a selection of a hot-water supplying, an air conditioning, and a heating.

* * * * *